US007370757B2

(12) United States Patent
Scheid, Sr. et al.

(10) Patent No.: US 7,370,757 B2
(45) Date of Patent: May 13, 2008

(54) HOUSING CONTAINER AND METHOD FOR TRANSPORTING A PLURALITY OF INFORMATION HANDLING SYSTEMS

(75) Inventors: Robert J. Scheid, Sr., Pflugerville, TX (US); Dean Bruce Larson, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 394 days.

(21) Appl. No.: 11/143,397

(22) Filed: Jun. 2, 2005

(65) Prior Publication Data

US 2006/0288659 A1 Dec. 28, 2006

(51) Int. Cl.

| | |
|---|---|
| ***B65D 85/038*** | (2006.01) |
| ***B65D 81/02*** | (2006.01) |
| ***B65D 19/00*** | (2006.01) |
| ***B65D 5/00*** | (2006.01) |

(52) U.S. Cl. ..... 206/320; 206/589; 206/598; 206/723; 206/725; 229/122

(58) Field of Classification Search .. 206/308.1–308.3, 206/309–313, 320, 386, 387.1–387.15, 521, 206/523, 526, 595–600, 701, 706–709, 721, 206/723, 588–590, 725; 229/122, 123, 247
See application file for complete search history.

(56) References Cited

U.S. PATENT DOCUMENTS

| | | | | |
|---|---|---|---|---|
| 3,015,430 | A * | 1/1962 | Bauer | 229/122 |
| 3,613,871 | A * | 10/1971 | Evans | 206/387.15 |
| 4,293,070 | A * | 10/1981 | Ohlbach | 206/709 |
| 4,482,048 | A * | 11/1984 | Blodgett | 206/721 |
| 4,884,692 | A * | 12/1989 | Middlebrooks | 206/308.3 |
| 4,966,280 | A * | 10/1990 | Bradford | 206/721 |
| 5,398,808 | A * | 3/1995 | Chen et al. | 206/320 |
| 5,417,342 | A | 5/1995 | Hutchison | |
| 5,595,304 | A * | 1/1997 | Timmins | 206/598 |
| 6,073,760 | A * | 6/2000 | Roemer et al. | 229/122 |
| 6,554,133 | B1 | 4/2003 | Kropf et al. | |
| 2002/0130167 | A1* | 9/2002 | Riedi | 229/122 |

* cited by examiner

*Primary Examiner*—Bryon P Gehman
(74) *Attorney, Agent, or Firm*—Haynes and Boone, LLP

(57) ABSTRACT

An information handling system transporting apparatus includes a housing container, and a plurality of information handling system containers which are positionable in the housing container, each information handling system container including a padding member for receiving a plurality of information handling systems. A plurality of information handling systems may be positioned in the information handling system containers and transported at a lower cost relative to conventional methods.

17 Claims, 19 Drawing Sheets

HOUSING CONTAINER AND METHOD FOR TRANSPORTING A PLURALITY OF INFORMATION HANDLING SYSTEMS

BACKGROUND

The present disclosure relates generally to information handling systems, and more particularly to transporting a plurality of information handling systems.

As the value and use of information continues to increase, individuals and businesses seek additional ways to process and store information. One option is an information handling system. An information handling system generally processes, compiles, stores, and/or communicates information or data for business, personal, or other purposes. Because technology and information handling needs and requirements may vary between different applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Some customers may have the need for large quantities of information handling systems. For customers who order large quantities of information handling systems, a number of issues arise with respect to the transporting of those information handling systems to the customer. The information handling systems may be transported with each information handling system individually packaged. However, this method is costly and results in a large amount of leftover transporting material. In addition, some customers require reusable transportation methods that reduce or eliminate these leftover transporting materials before they will purchase the information handling systems. Furthermore, such ecological concerns and customer requirements for ecologically friendly delivery are expected to increase in the future.

Conventional reusable methods for transporting large quantities of information handling systems utilize large shipping containers which are fabricated from metal, plastic, and wood and can cost thousands of dollars. These containers are large, heavy, expensive to build and ship, difficult to load and unload, present problems with scaling, and provide little flexibility with respect to transporting different sized information handling systems.

Accordingly, it would be desirable to provide for transporting a plurality of information handling systems absent the disadvantages found in the prior methods discussed above.

SUMMARY

According to one embodiment, an information handling system transporting apparatus is provided that includes a housing container and a plurality of information handling system containers which are positionable in the housing container, each information handling system container including a padding member for receiving a plurality of information handling systems A principal advantage of this embodiment is that a reusable, recyclable, scalable, low weight, and low cost apparatus for transporting a plurality of information handling systems is provided which may be flexibly configured to transport a variety of different sized information handling systems.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network server or storage device, a switch router or other network communication device, or any other suitable device and may vary in size, shape, performance, functionality, and price. The information handling system may include memory, one or more processing resources such as a central processing unit (CPU) or hardware or software control logic. Additional components of the information handling system may include one or more storage devices, one or more communications ports for communicating with external devices as well as various input and output (I/O) devices, such as a keyboard, a mouse, and a video display. The information handling system may also include one or more buses operable to transmit communications between the various hardware components.

Figure 1:
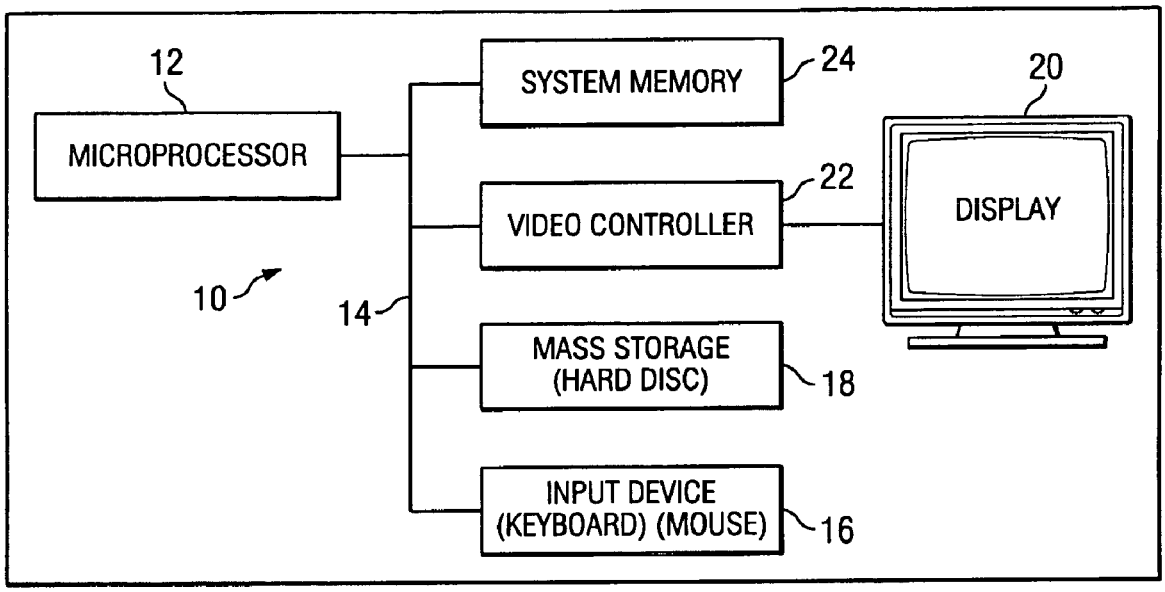
FIG. 1 is a schematic view illustrating an embodiment of an information handling system.

In one embodiment, information handling system 10, FIG. 1, includes a microprocessor 12, which is connected to a bus 14. Bus 14 serves as a connection between microprocessor 12 and other components of computer system 10. An input device 16 is coupled to microprocessor 12 to provide input to microprocessor 12. Examples of input devices include keyboards, touchscreens, and pointing devices such as mouses, trackballs and trackpads. Programs and data are stored on a mass storage device 18, which is coupled to microprocessor 12. Mass storage devices include such devices as hard disks, optical disks, magneto-optical drives, floppy drives and the like. Computer system 10 further includes a display 20, which is coupled to microprocessor 12 by a video controller 22. A system memory 24 is coupled to microprocessor 12 to provide the microprocessor with fast storage to facilitate execution of computer programs by microprocessor 12. It should be understood that other busses and intermediate circuits can be deployed between the components described above and microprocessor 12 to facilitate interconnection between the components and the microprocessor.

Figure 2:
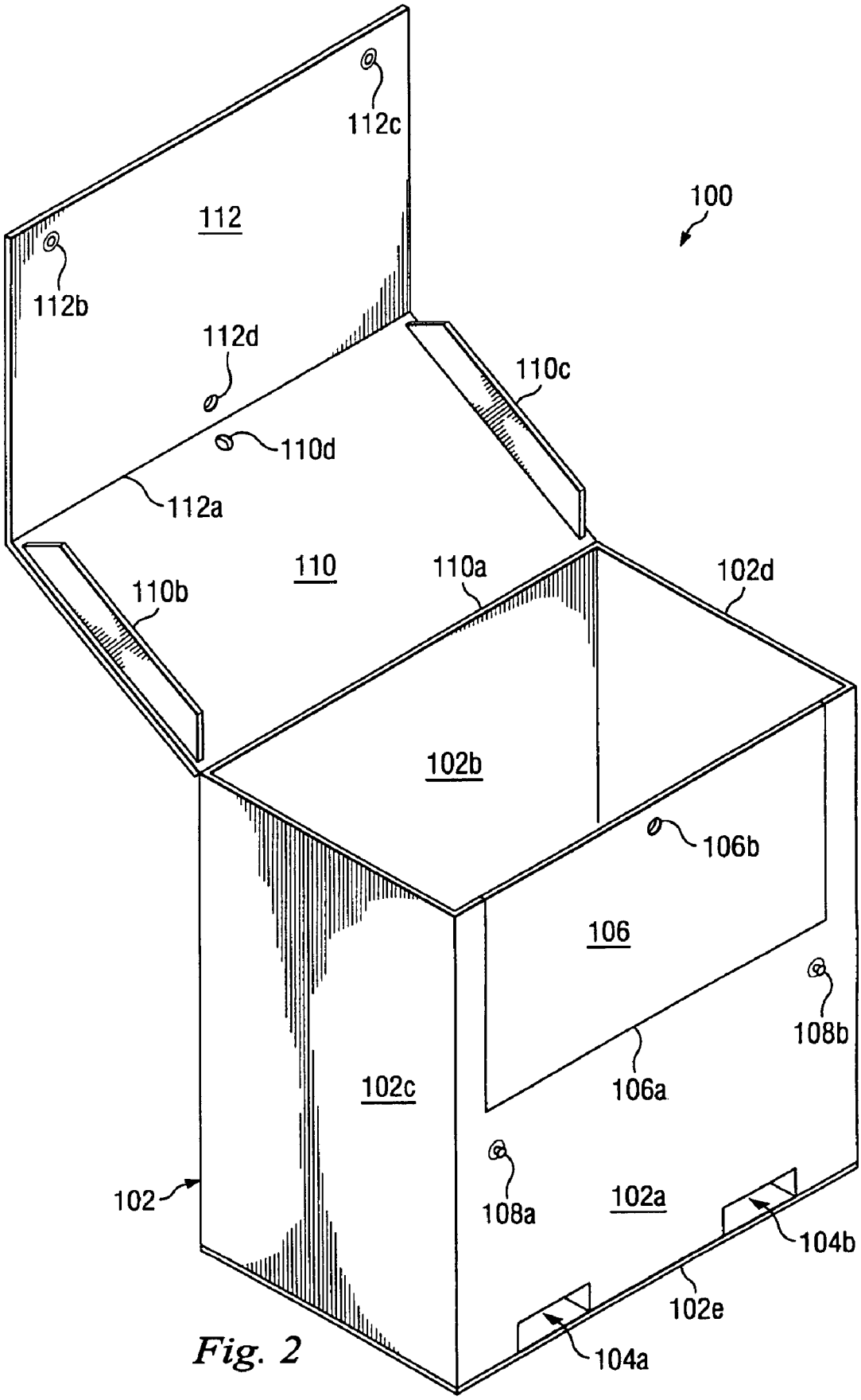
FIG. 2 is a perspective view illustrating an embodiment of a housing container.

Referring now to FIG. 2, a housing container 100 is illustrated. The housing container 100 includes a base 102 having a front wall 102*a*, a rear wall 102*b* located opposite the front wall 102*a*, a plurality of spaced apart side walls 102*c* and 102*d* extending between the front wall 102*a* and the rear wall 102*b*, and a bottom wall 102*e* extending between the front wall 102*a*, the rear wall 102*b*, and the plurality of side walls 102*c* and 102*d*. A plurality of lifting channels 104*a* and 104*b* are defined by the base 102 and are positioned adjacent the bottom wall 102*e*. In an embodiment, the plurality of lifting channels 104*a* and 104*b* extend through the housing from the front wall 102*a* to the rear wall 102*b*. In an embodiment, the plurality of lifting channels 104*a* and 104*b* extend through the housing from the side wall 102*c* to the side wall 102*d*. A loading door 106 is pivotally connected to the front wall 102*a* along a pivoting edge 106*a* and located on the front wall 102*a* opposite the lifting channels 104*a* and 104*b*. A securing aperture 106*b* is defined by the loading door 106 and located on the loading door 106 opposite the pivoting edge 106*a*. A plurality of securing pins 108*a* and 108*b* are positioned on and extend from the front wall 102*a* in a spaced apart relationship on opposite sides of the loading door 106. A housing lid 110 extends from the rear wall 102*b* and is pivotally connected to the rear wall 102*b* along a pivoting edge 110*a*. The housing lid 110 includes a plurality of coupling arms 110*b* and 11*c* extending from opposite ends of the housing lid 110 and defines a securing aperture 110*d* located on the housing lid 110 opposite the pivoting edge 110*a*. A lid securing portion 112 extends from the housing lid 110 and is pivotally coupled to the housing lid 110 along a pivoting edge 112*a*. The lid securing portion 112 includes a plurality of securing members 112*b* and 112*c* located adjacent an edge of the lid securing portion 112 in a spaced apart relationship opposite the pivoting edge 112*a*. A securing aperture 112*d* is defined by the lid securing portion 112 and positioned adjacent the pivoting edge 112*a*. In an embodiment, the housing container 100 may be fabricated from a variety of corrugated material known in the art such as, for example, cardboard.

Figure 3:
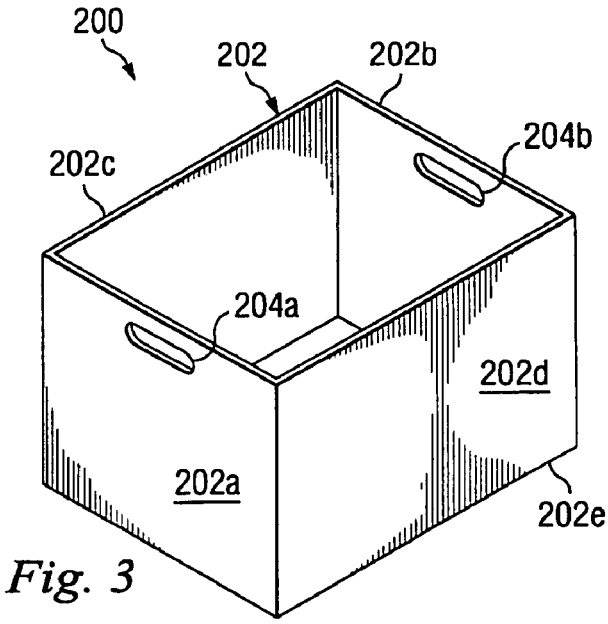
FIG. 3 is a perspective view illustrating an embodiment of an information handling system container used with the housing container of FIG. 2.

Referring now to FIG. 3, an information handling system container 200 is illustrated. Information handling system container 200 includes a base 202 having a front wall 202*a*, a rear wall 202*b* located opposite the front wall 202*a*, a plurality of side walls 202*c* and 202*d* extending between the front wall 202*a* and the rear wall 202*b*, and a bottom wall 202*e* extending between the front wall 202*a*, the rear wall 202*b*, and the plurality of side walls 202*c* and 202*d*. A handle aperture 204*a* is defined by the front wall 202*a* and located on an edge of the front wall 202*a* opposite the bottom wall 202*e*. A handle aperture 204*b* is defined by the rear wall 202*b* and located on an edge of the rear wall 202*b* opposite the bottom wall 202*e*. In an embodiment, the information handling system container 200 may be fabricated from a variety of corrugated material known in the art such as, for example, cardboard.

Figure 4:
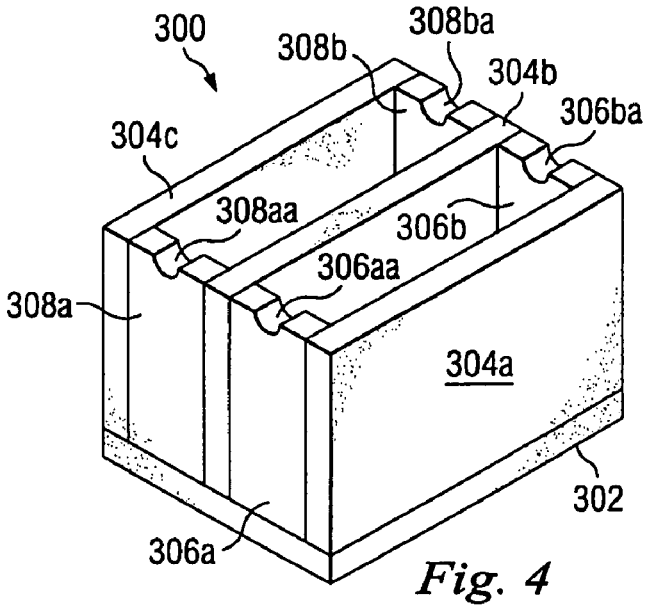
FIG. 4 is a perspective view illustrating an embodiment of a padding member used with the information handling system container of FIG. 2.

Referring now to FIG. 4, a padding member 300 is illustrated. Padding member 300 includes a base member 302 with a plurality of side walls 304*a*, 304*b*, and 304*c* extending from the base member 302 in a substantially parallel, spaced apart relationship. A front wall 306*a* and a rear wall 306*b* extend from the base member 302 and between the sides walls 304*a* and 304*b* in a spaced apart relationship on opposite ends of the side walls 304*a* and 304*b*. An access channel 306*a* a is defined by the front wall 306*a* and substantially centrally located on an edge of the front wall 306*a* between the side walls 304*a* and 304*b*. An access channel 306*b* a is defined by the rear wall 306*b* and substantially centrally located on an edge of the rear wall 306*b* between the side walls 304*a* and 304*b*. A front wall 308*a* and a rear wall 308*b* extend from the base member 302 and between the sides walls 304*b* and 304*c* in a spaced apart relationship on opposite ends of the side walls 304*b* and 304*c*. An access channel 308*aa* is defined by the front wall 308*a* and substantially centrally located on an edge of the front wall 308*a* between the side walls 304*b* and 304*c*. An access channel 308*ba* is defined by the rear wall 308*b* and substantially centrally located on an edge of the rear wall 308*b* between the side walls 304*b* and 304*c*. In an embodiment, the padding member 300 may be fabricated from a variety of materials known in the art such as, for example, foam.

Figure 5:
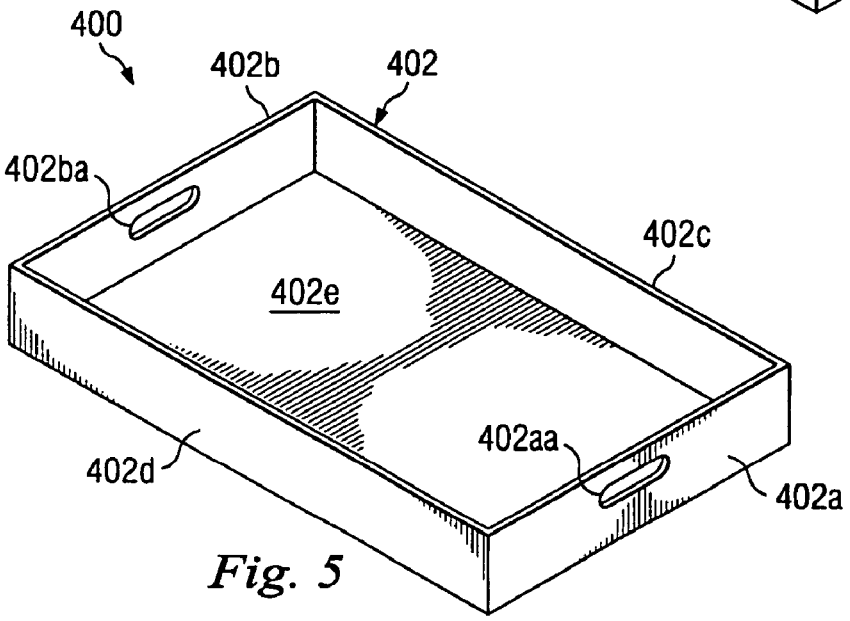
FIG. 5 is a perspective view illustrating an embodiment of a system component container used with the housing container of FIG. 2.

Referring now to FIG. 5, a system component container 400 is illustrated. System component container 400 includes a base 402 having a front wall 402*a*, a rear wall 402*b* located opposite the front wall 402*a*, a plurality of side walls 402*c* and 402*d* extending between the front wall 402*a* and the rear wall 402*b*, and a bottom wall 402*e* extending between the front wall 402*a*, the rear wall 402*b*, and the plurality of side walls 402*c* and 402*d*. A handle aperture 402*aa* is defined by the front wall 402*a* and located on an edge of the front wall 402*a* opposite the bottom wall 402*e*. A handle aperture 402*ba* is defined by the rear wall 402*b* and located on an edge of the rear wall 402*b* opposite the bottom wall 402*e*. In an embodiment, the system component container 400 may be fabricated from a variety of corrugated material known in the art such as, for example, cardboard.

Figure 6:
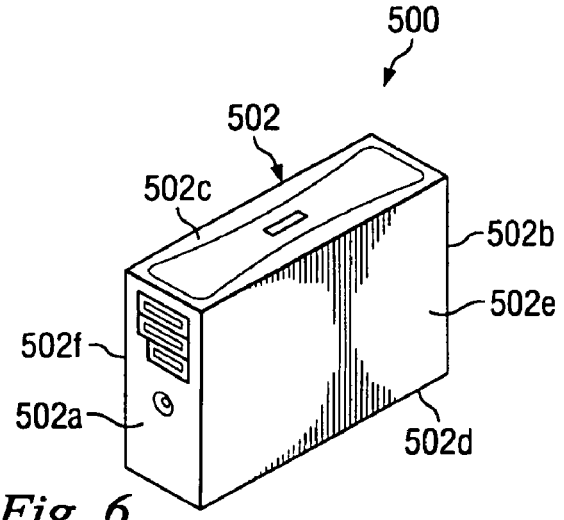
FIG. 6 is a perspective view illustrating an embodiment of an information handling system used with the information handling system container of FIG. 3 and the padding member of FIG. 4.

Referring now to FIG. 6, an information handling system 500, which may be the information handling system 10 described above with reference to FIG. 1, is illustrated. Information handling system 500 includes a base 502 having a front surface 502, a rear surface 502*b* located opposite the front surface 502*a*, a top surface 502*c* extending between the front surface 502*a* and the rear surface 502*b*, a bottom surface 502*d* located opposite the top surface 502*c* and extending between the front surface 502*a* and the rear surface 502*b*, and a plurality of side surfaces 502*e* and 502f extending between the front surface 502*a*, the rear surface 502*b*, the top surface 502*c*, and the bottom surface 502*d*.

Figure 7B:
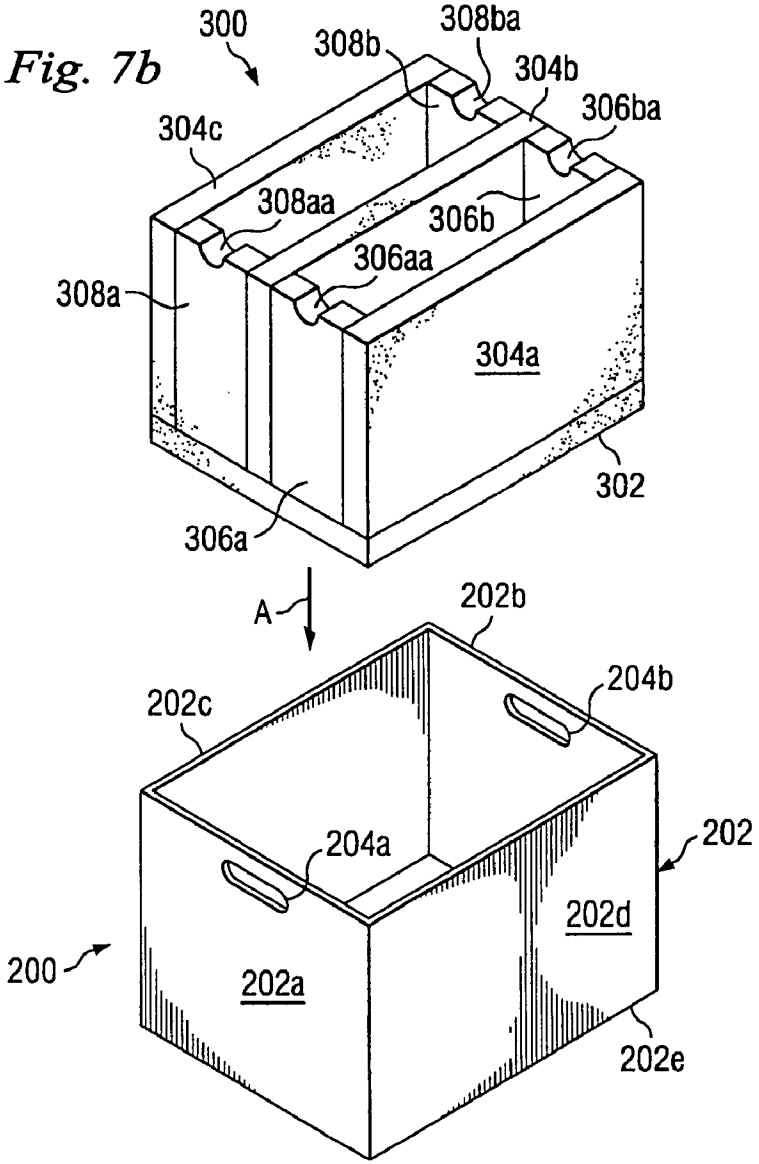
FIG. 7*b* is a perspective view illustrating an embodiment of the padding member of FIG. 4 being positioned in the information handling system container of FIG. 3.
Figure 7A:
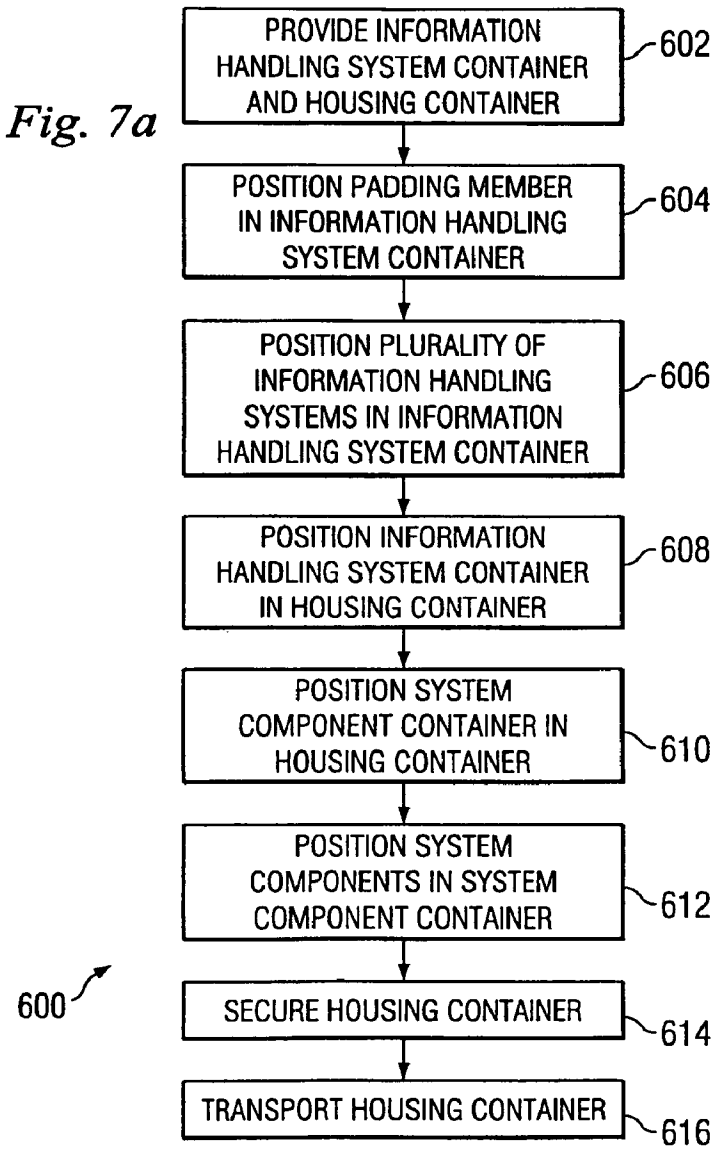
FIG. 7*a* is a flow chart illustrating an embodiment of a method for transporting a plurality of information handling systems.
Figure 7C:
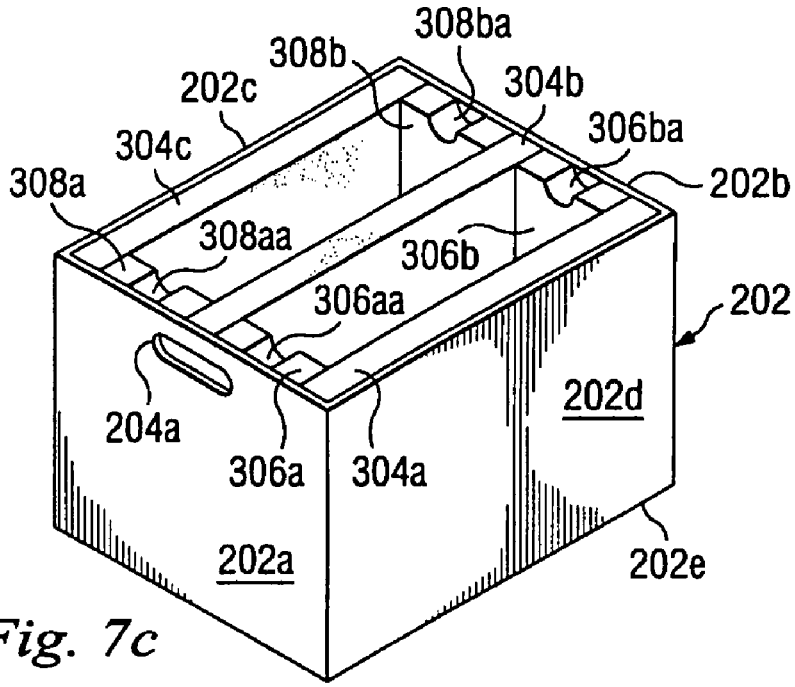
FIG. 7*c* is a perspective view illustrating an embodiment of the padding member of FIG. 4 positioned in the information handling system container of FIG. 3.

Referring now to FIGS. 2, 3, 7*a*, 7*b*, and 7*c*, a method 600 for transporting a plurality of information handling systems is illustrated. The method 600 begins at step 602 where the information handling system container 200 and the housing container 100 are provided. The method 600 then proceeds to step 604 where the padding member 300 is positioned in the information handling system container 200. The padding member 200 is positioned adjacent the information handling system container 200 such that the base member 302 is immediately adjacent the information handling system container 100 and with side wall 304*a* on padding member 300 lining up with side wall 202*d* on information handling system container 200 and side wall 304*c* on padding member 300 lining up with side wall 202*c* on information handling system container 200, as illustrated in FIG. 7*b*. The padding member 300 is then moved in a direction A such that it enters the information handling system container 200 and side wall 304*a* on padding member 300 engages side wall 202*d* on information handling system container 200 and side wall 304*c* on padding member 300 engages with side wall 202*c* on information handling system container 200, as illustrated in FIG. 7*c*.

Figure 7E:
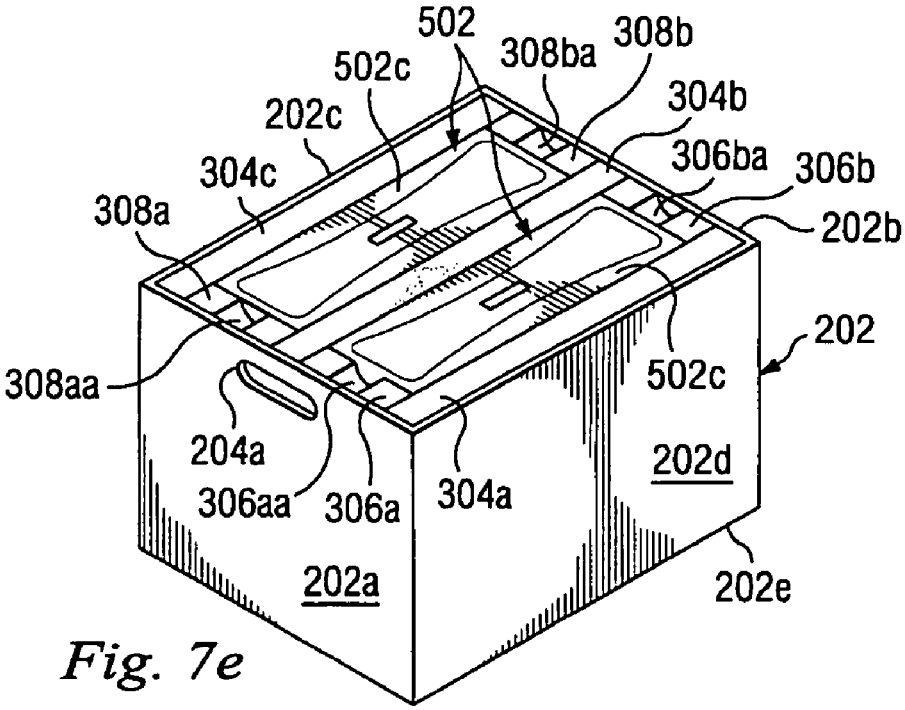
FIG. 7*e* is a perspective view illustrating an embodiment of a plurality of the information handling systems of FIG. 6 positioned in the information handling system container and padding member of FIG. 7*c*.
Figure 7D:
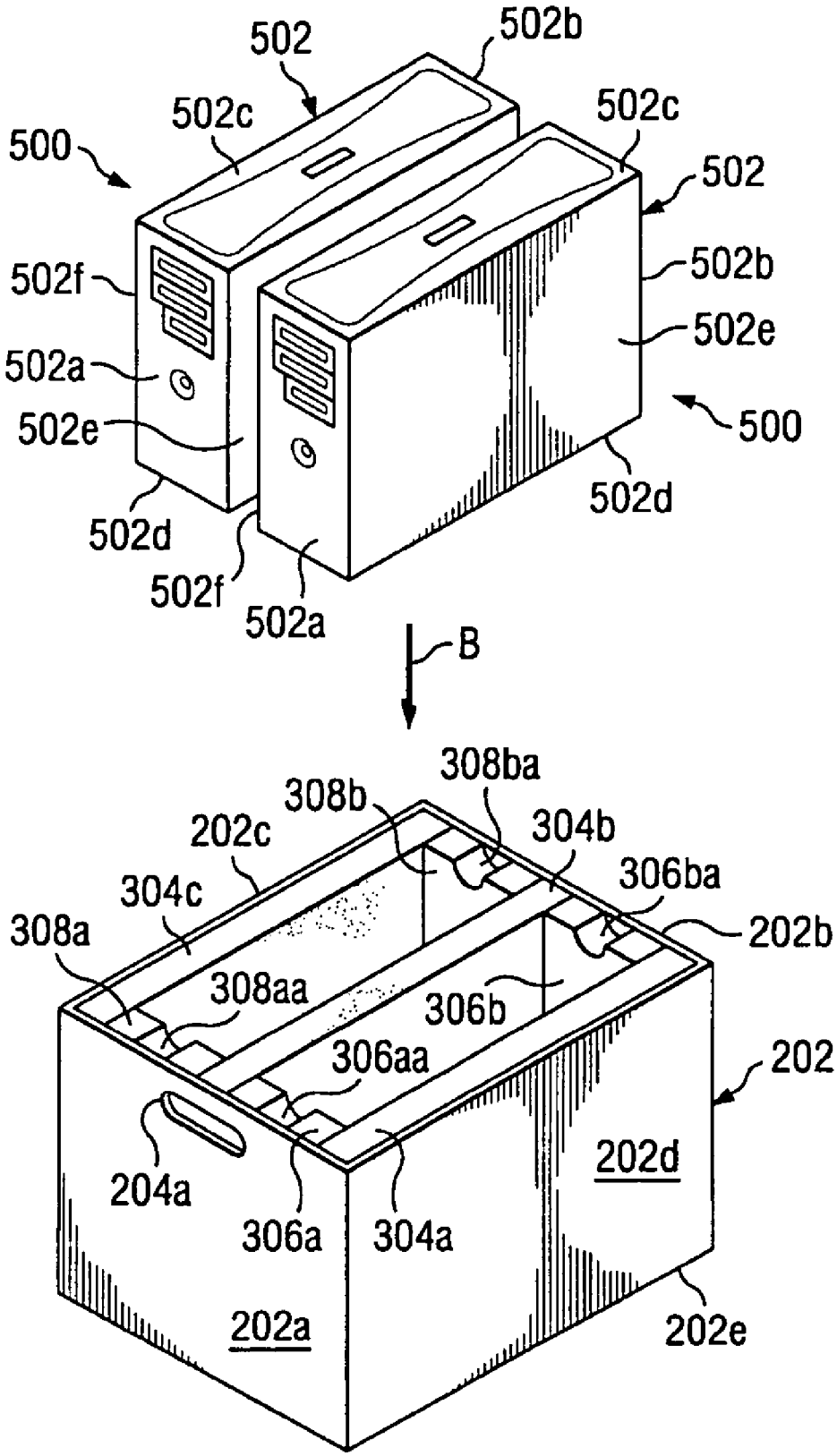
FIG. 7*d* is a perspective view illustrating an embodiment of a plurality of the information handling systems of FIG. 6 being positioned in the information handling system container and padding member of FIG. 7*c*.

Referring now to FIGS. 7*a*, 7*d*, and 7*e*, the method 600 proceeds to step 606 where a plurality of the information handling systems 500 are positioning in the information handling system container 200. An information handling system 500 is positioned adjacent the information handling system container 200 and padding member 300 such that the bottom surface 502*d* of the information handling system 500 is immediately adjacent the information handling system container 200 and the side surface 502*e* on information handling system 500 lines up with the side wall 304*a* on padding member 300 and the side surface 502*f* on information handling system 500 lines up with the side wall 304*b* on padding member 300, as illustrated in FIG. 7*d*. Another information handling system 500 is positioned adjacent the information handling system container 200 and padding member 300 such that the bottom surface 502*d* of the information handling system 500 is immediately adjacent the information handling system container 200 and the side surface 502*e* on information handling system 500 lines up with the side wall 304*b* on padding member 300 and the side surface 502*f* on information handling system 500 lines up with the side wall 304*c* on padding member 300, as illustrated in FIG. 7*d*. One of the information handling systems 500 is then moved in a direction B such that it enters the information handling system container 200 and the side surface 502*e* on information handling system 500 engages the side wall 304*a* on padding member 300 and the side surface 502*f* on information handling system 500 engages the side wall 304*b* on padding member 300. The other information handling systems 500 is then moved in a direction B such that it enters the information handling system container 200 and the side surface 502*e* on information handling system 500 engages the side wall 304*b* on padding member 300 and the side surface 502*f* on information handling system 500 engages the side wall 304*c* on padding member 300, as illustrated in FIG. 7*e*. During the positioning of the information handling systems 500 in the information handling system container 200, the access channels 306*aa*, 306*ba*, 308*aa*, and 308*ba* on the padding member 300 assist in the positioning and removal of the information handling systems 500 by providing access to the front surface 502*a* and the rear surface 502*b* of the information handling systems 500.

Figure 7F:
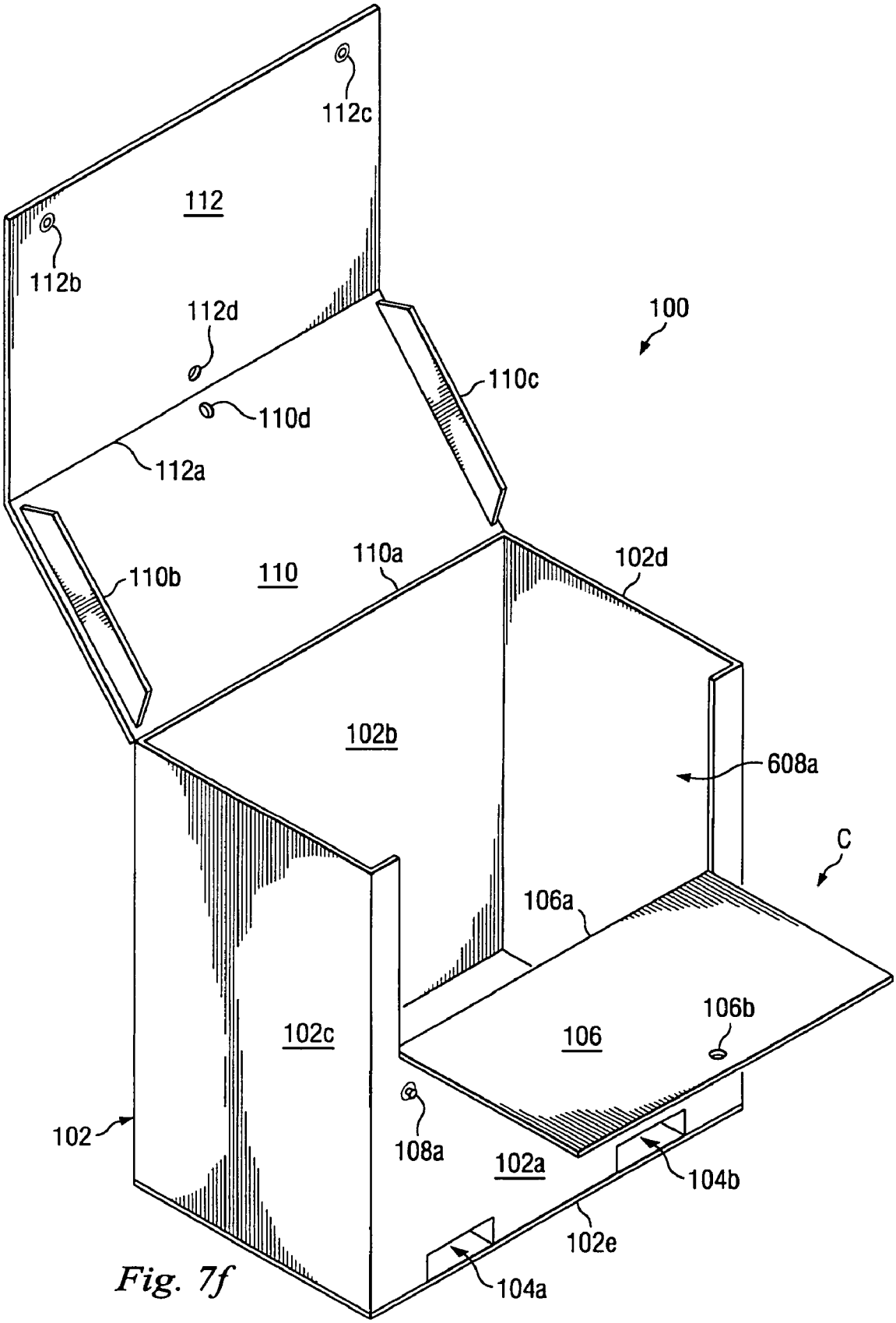
FIG. 7*f* is a perspective view illustrating an embodiment of the housing container of FIG. 2 with the loading door in an open position.
Figure 7G:
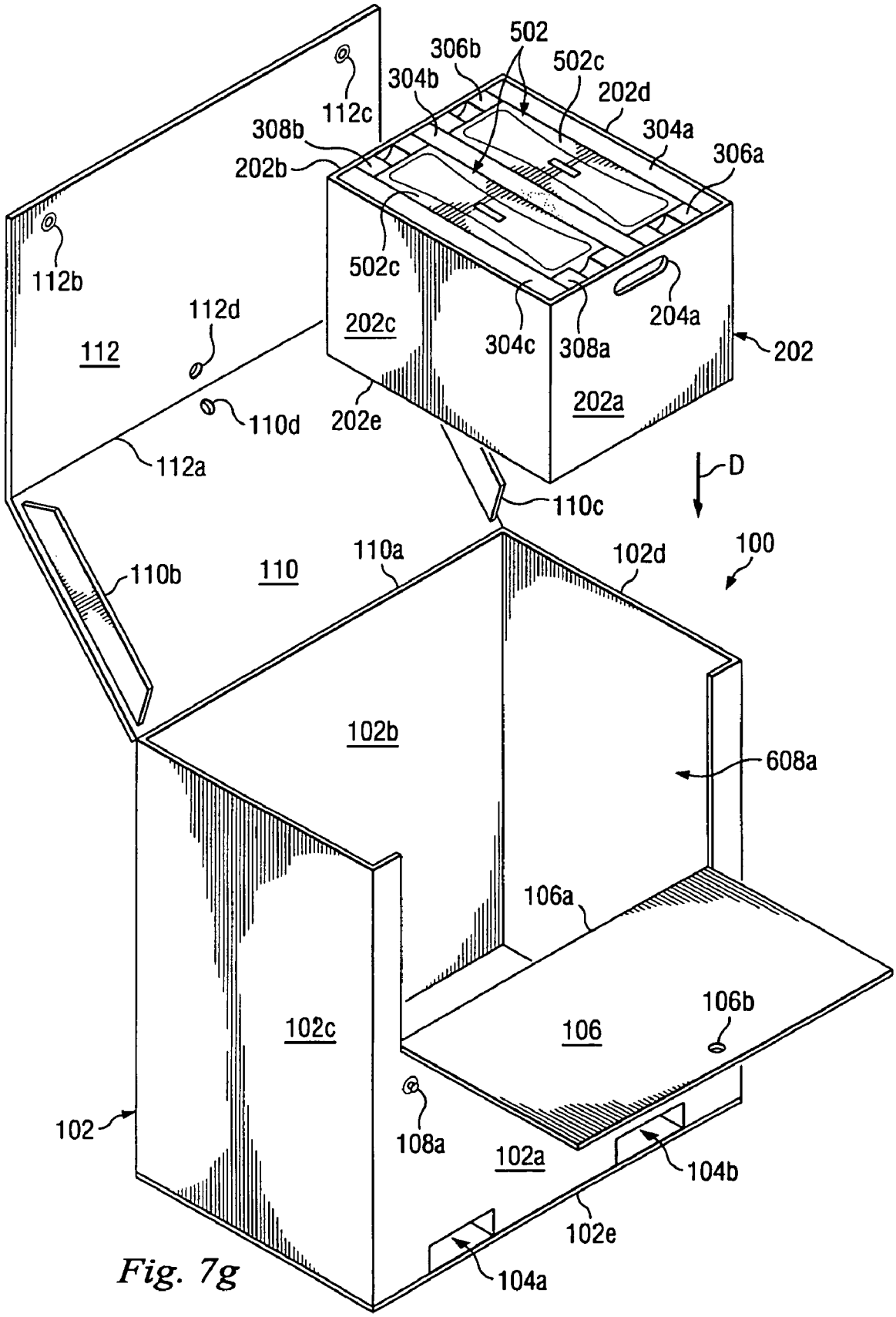
FIG. 7*g* is a perspective view illustrating an embodiment of the information handling system container, the padding member, and the information handling systems of FIG. 7*e* being positioned in the housing container of FIG. 7*f*.
Figure 7H:
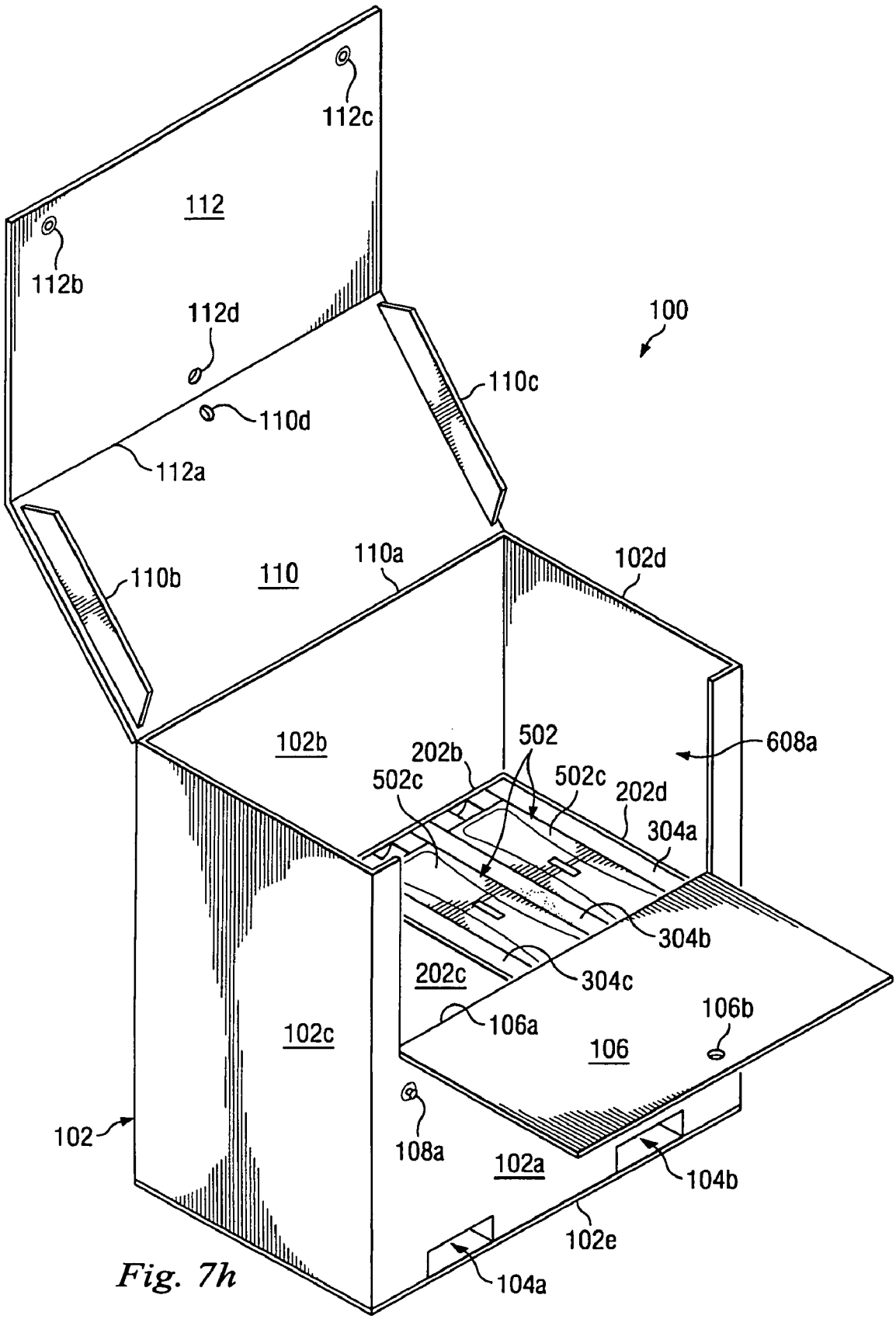
FIG. 7*h* is a perspective view illustrating an embodiment of the information handling system container, the padding member, and the information handling systems of FIG. 7*e* positioned in the housing container of FIG. 7*f*.
Figure 7I:
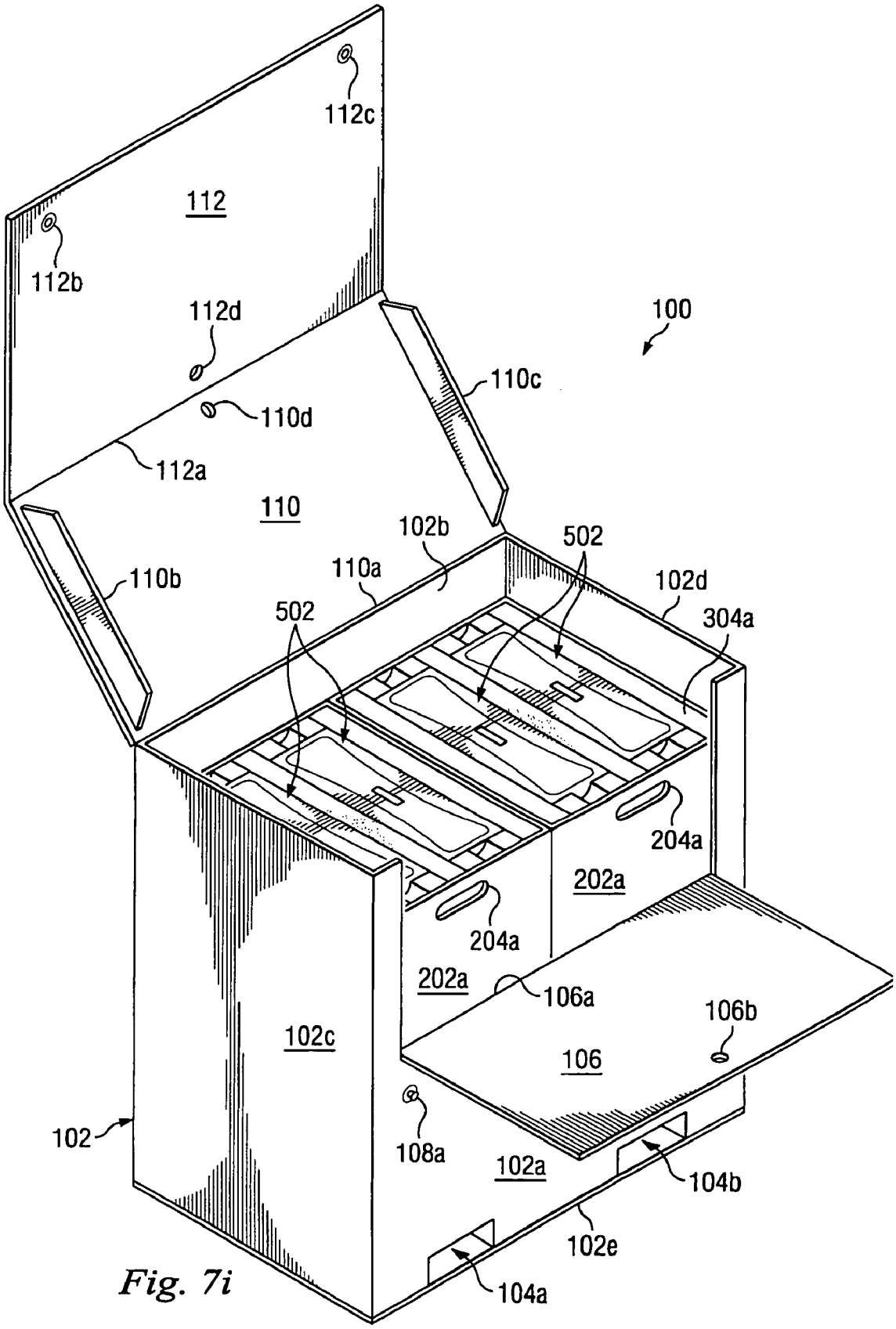
FIG. 7*i* is a perspective view illustrating an embodiment of a plurality of the information handling system containers, the padding members, and the information handling systems of FIG. 7*e* positioned in the housing container of FIG. 7*f*.

Referring now to FIGS. 7*a*, 7*f*, 7*g*, 7*h*, and 7*i*, the method 600 proceeds to step 608 where the information handling system container 200 with padding member 300 and information handling systems 500 are positioned in the housing container 100. The loading door 106 on housing container 100 is pivoted about pivoting edge 106*a* and into a position C, as illustrated in FIG. 7*f*, such that a loading channel 608*a* exists in the housing container 100. The information handling system container 200 with padding member 300 and information handling systems 500 is then positioned adjacent the housing container 100 such that side wall 202*d* on information handling system container 200 is adjacent the side wall 102*d* on housing container 102*d*, as illustrated in FIG. 7*g*. The information handling system container 200 may then be moved in a direction D such that the information handling system container 200 enters the housing container 100 and the side wall 202*d* on information handling system container 200 engages the side wall 102*d* on housing container 102*d*, as illustrated in FIG. 7*h*. A plurality of the information handling system containers 200 may be positioned in the housing container 100 using substantially the same method as described above in step 608, as illustrated in FIG. 7*i*. In an embodiment, a padding layer may be placed between adjacent information handling system containers 200. In an embodiment, the loading channel 608*a* provides an ergonomic means for positioning the information handling system containers 200 in the housing container 100.

Figure 7J:
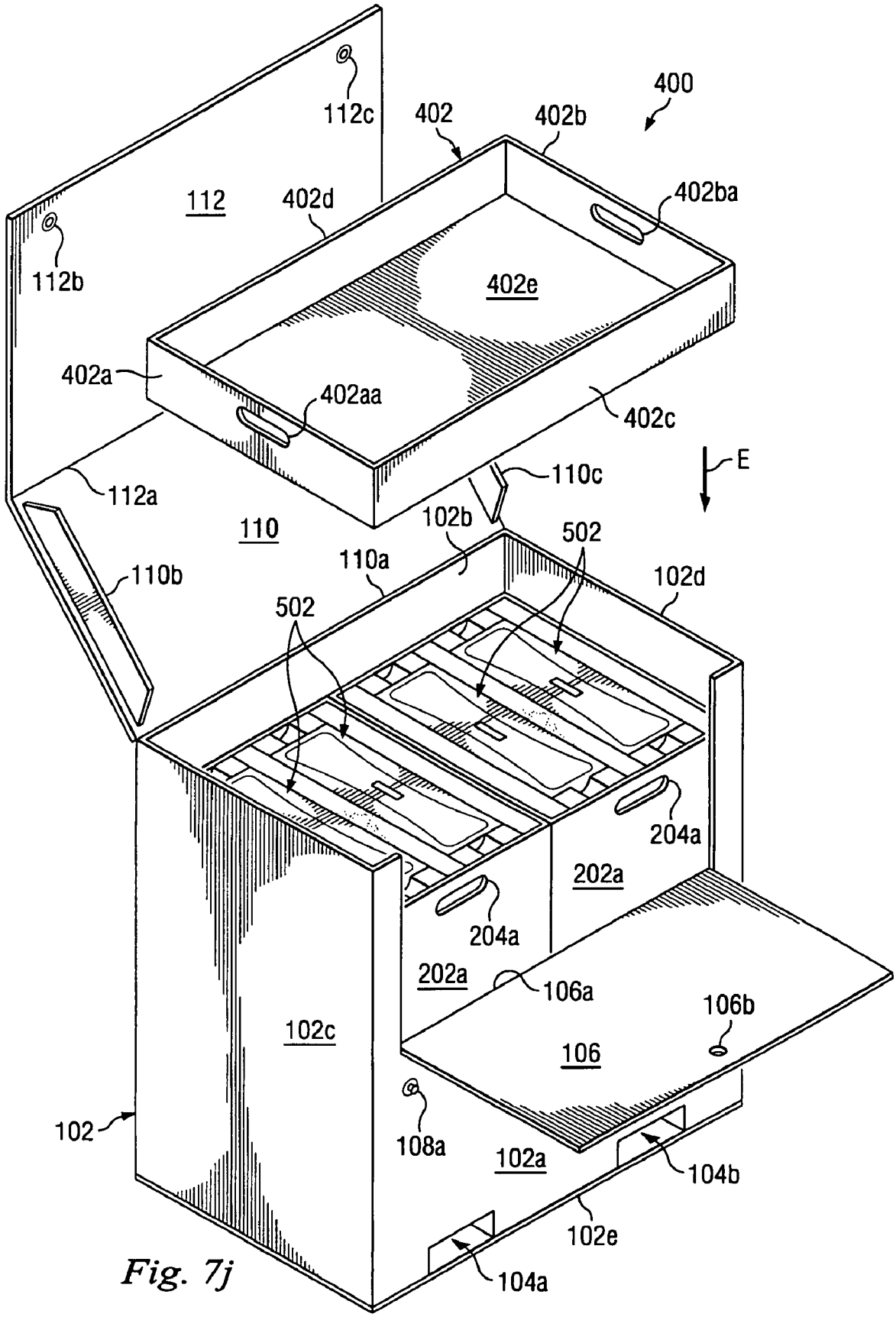
FIG. 7*j* is a perspective view illustrating an embodiment of the system component container of FIG. 5 being positioned in the housing container of FIG. 7*i*.
Figure 7K:
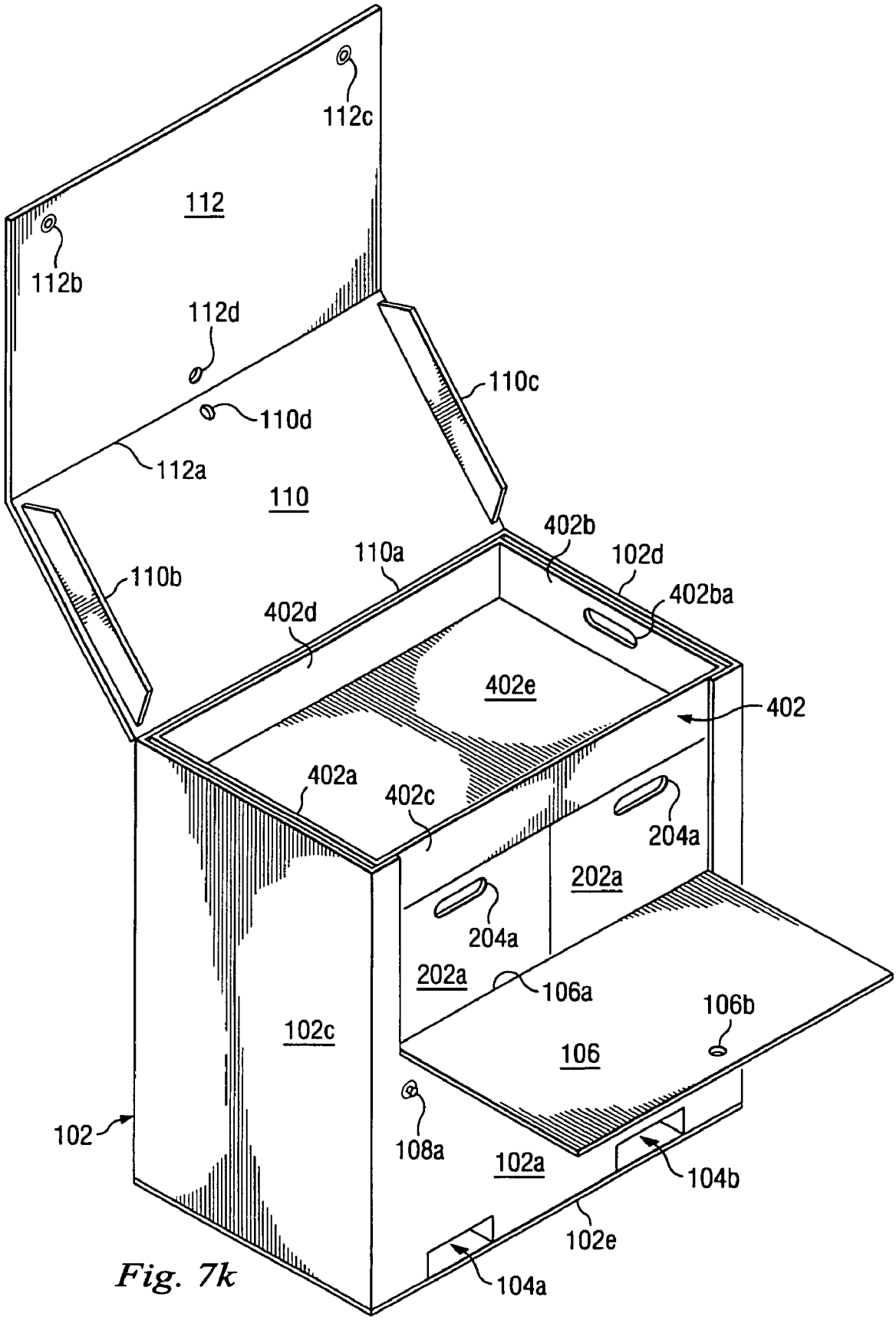
FIG. 7*k* is a perspective view illustrating an embodiment of the system component container of FIG. 5 positioned in the housing container of FIG. 7*i*.
Figure 7L:
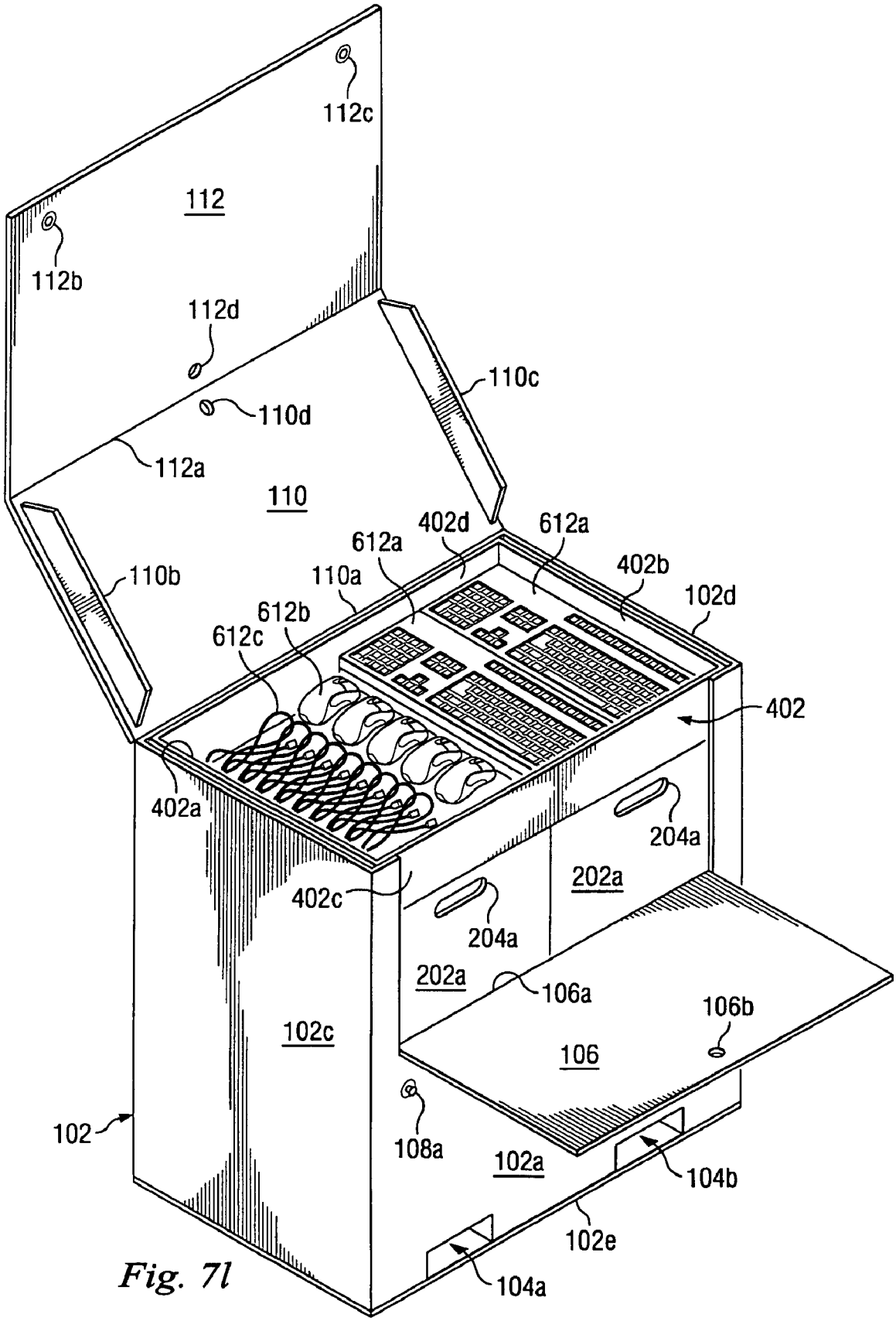
FIG. 7*l* is a perspective view illustrating an embodiment of a plurality of system components positioned in the system component container and the housing container of FIG. 7*k*.

Referring now to FIGS. 7*a*, 7*j*, and 7*k*, the method 600 proceeds to step 610 where the system component container 400 is positioned in the housing container 100. The system component container 400 is positioned adjacent the housing container 100 such that front wall 402*a* on system component container 400 is adjacent side wall 102*c* on housing container 100 and rear wall 402*b* on system component container 400 is adjacent side wall 102*d* on housing container 100, as illustrated in FIG. 7*j*. The system component container 400 is then moved in a direction E such that the system component container 400 enters the housing container 100 with front wall 402*a* on system component container 400 engaging side wall 102*c* on housing container 100 and rear wall 402*b* on system component container 400 engaging side wall 102*d* on housing container 100, as illustrated in FIG. 7*k*. In an embodiment, the bottom wall 402*e* on system component container 400 may directly engage the information handling system containers 200 in housing container 100. In an embodiment, a padding layer may be positioned between the bottom wall 402*e* on system component container 400 and the information handling system containers 200 in housing container 100.

Referring now to FIGS. 7*a* and 71, the method 600 then proceeds to step 612 where a plurality of system components are positioned in the system component container 400. For example, a plurality of keyboards 612*a*, a plurality of mouse devices 612*b*, and a plurality of connector cables 612*c* may be positioned in the system component container, as illustrated in FIG. 71. In an embodiment, a variety of different information handling system components may be positioned in the system component container 400 such as, for example, any of the components of the information handling system 10, described above with reference to FIG. 1.

Figure 7M:
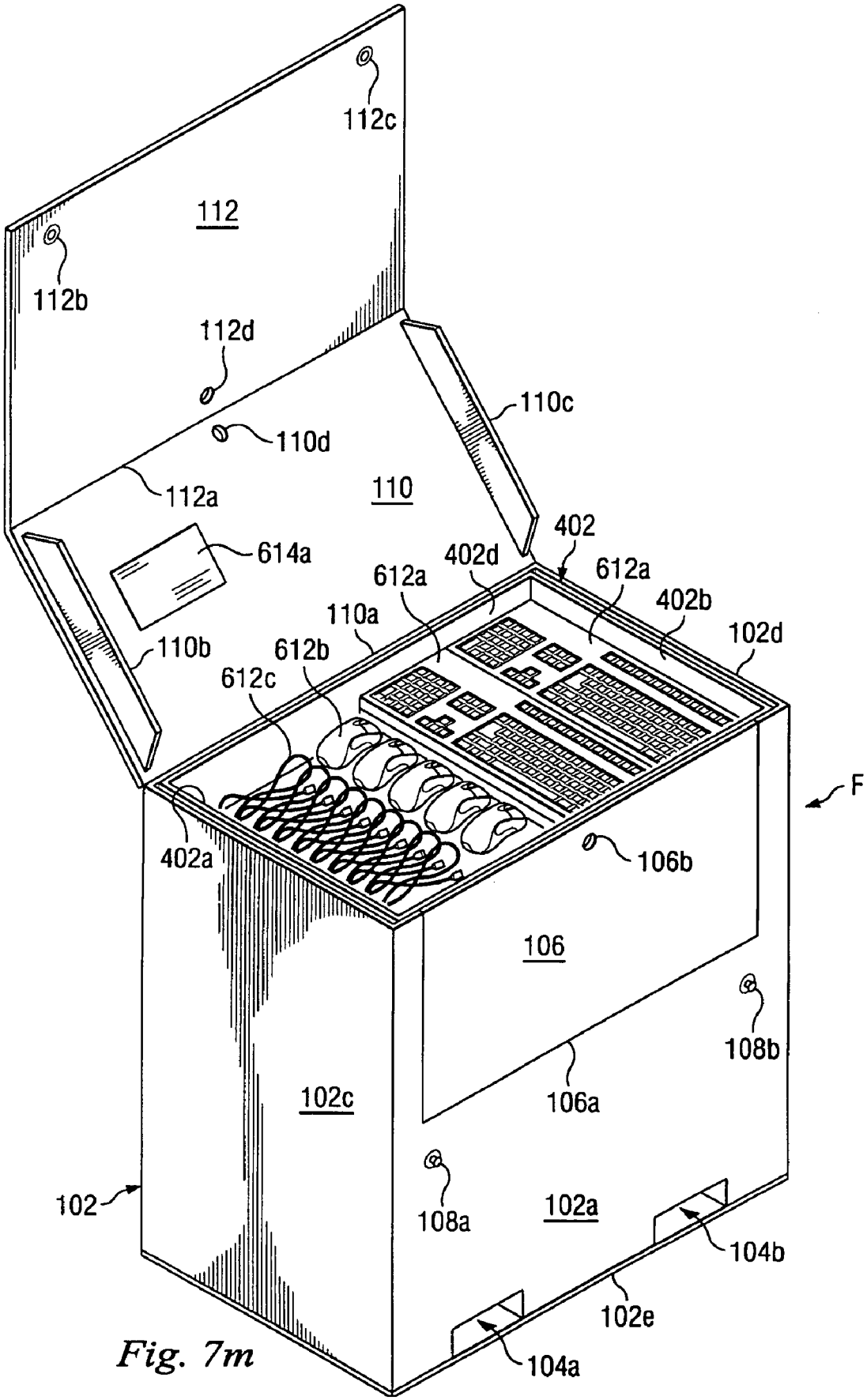
FIG. 7*m* is a perspective view illustrating an embodiment of the housing container of FIG. 7*l* with the loading door in a closed position.
Figure 7N:
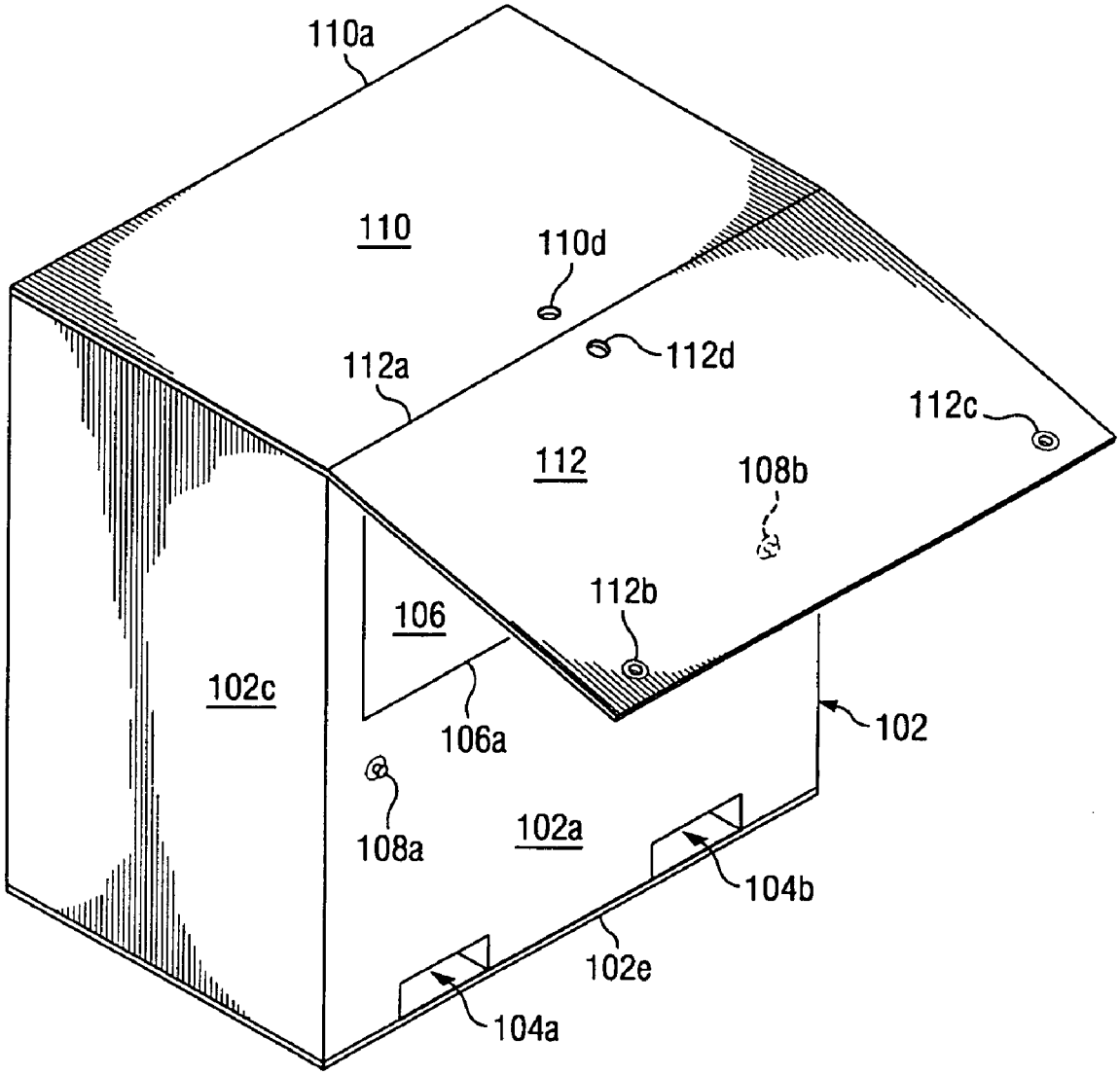
FIG. 7*n* is a perspective view illustrating an embodiment of the housing container of FIG. 7*m* with the housing lid in a closed position.
Figure 7O:
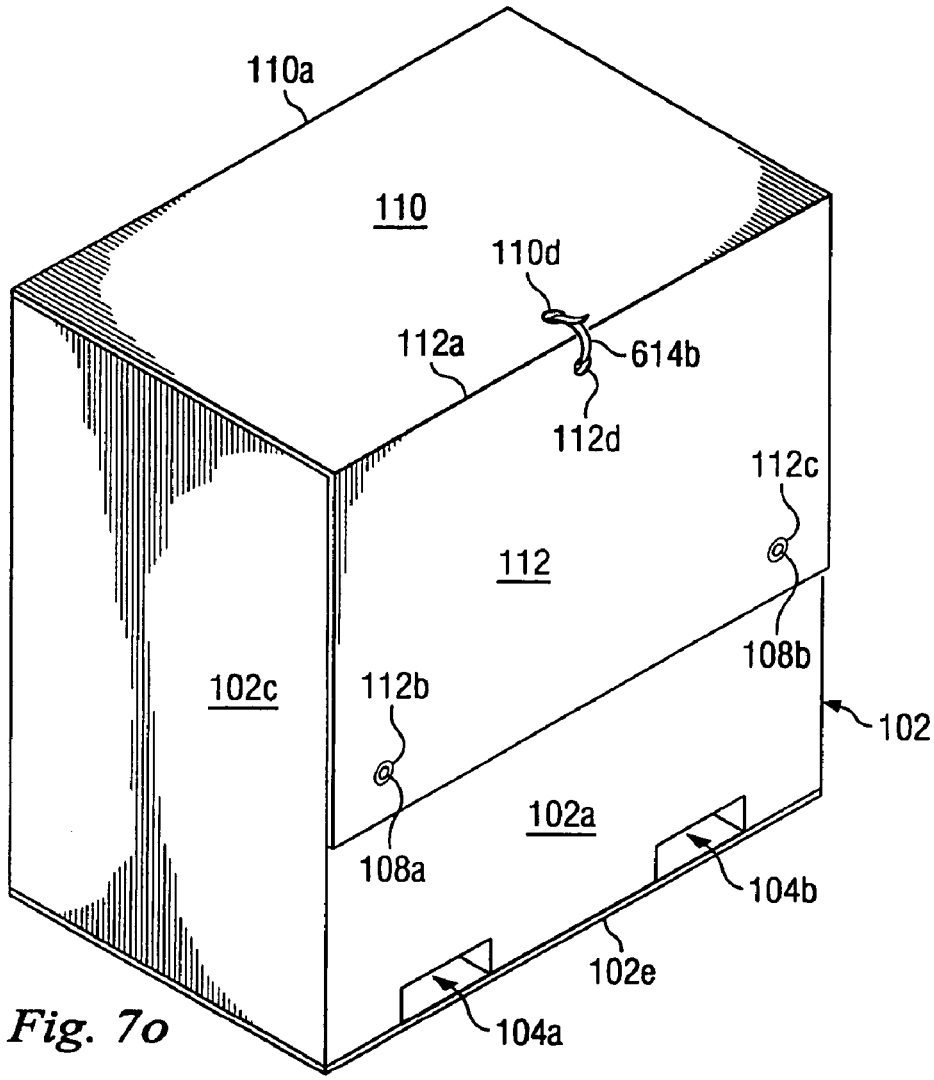
FIG. 7*o* is a perspective view illustrating an embodiment of the housing container of FIG. 7*n* with the loading door in a secured position.

Referring now to FIGS. 7*a*, 7*m*, 7*n* and 70, the method 600 proceeds to step 614 where the housing container 100 is secured. The loading door 106 on the housing container 100 is pivoted about pivoting edge 106*a* into a position F such that the loading door 106 is substantially coplanar with the front wall 102*a* of housing container 100, as illustrated in FIG. 7*m*. Transporting information 614*a* such as, for example, an airbill, may be secured to the housing lid 110. The housing lid 110 is then pivoted about pivoting edge 110*a*. As the housing lid 110 is pivoting, the coupling arm 110*b* is positioned in the housing container 100 between the side wall 102*c* on housing container 100 and the side wall 402*a* on the system component container 400, and the coupling arm 110*c* is positioned in the housing container 100 between the side wall 102*d* on housing container 100, and the side wall 402*b* on the system component container 400, as illustrated in FIG. 7*n*. Due to the positioning of the transporting information 614*a*, the pivoting of the housing lid 110 provides a protection for the transporting information 614*a* during transportation. The lid securing portion 112 is then pivoted about the pivoting edge 112*a* such that the securing members 112*b* and 112*c* engage the securing pins 108*a* and 108*b*, securing the lid securing portion 112 to the front surface 102*a* of the housing container 100, as illustrated in FIG. 7*o*. In an embodiment, a security tie 614*b* which may be, for example, a conventional truck seal, is positioned through the securing aperture 110*d* on the housing lid 110, the securing aperture 112*d* on the lid securing member 112 and the securing aperture 106*b* on the loading door 106. In an embodiment, with the housing lid 110 secured, the housing container is approximately the same size and dimensions as a conventional half-pallet. The method 600 then proceeds to step 606 where the housing container 100 is transported. The lifting channels 104*a* and 104*b* may be used to lift the housing container 100 with a conventional lifting vehicle such as, for example, a forklift. The housing container 100 may then be placed in a conventional shipping vehicle and transported.

Figure 8:
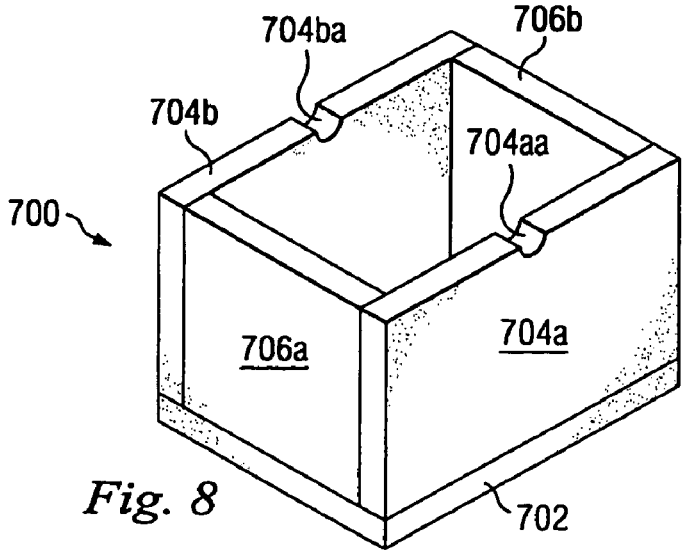
FIG. 8 is a perspective view illustrating an embodiment of a padding member used with the information handling system container of FIG. 3.

Referring now to FIG. 8, in an embodiment, a padding member 700 is illustrated which includes a base member 702 with a plurality of side walls 704*a* and 704*b* extending from the base member 702 in a substantially parallel, spaced apart relationship. An access channel 704*aa* is defined by the side wall 704*a* and substantially centrally located on an edge of the side wall 704*a*. An access channel 704*ba* is defined by the side wall 704*b* and substantially centrally located on an edge of the side wall 704*b*. A front wall 706*a* and a rear wall 706*b* extend from the base member 702 and between the sides walls 704*a* and 704*b* in a spaced apart relationship on opposite sides of the side walls 704*a* and 704*b*. In an embodiment, the padding member 700 may be fabricated from a variety of materials known in the art such as, for example, foam.

Figure 9:
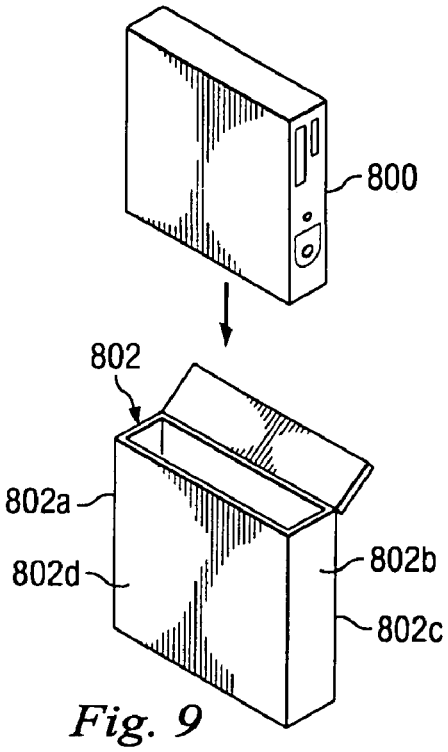
FIG. 9 is a perspective view illustrating an embodiment of an information handling system used with the padding member of FIG. 8 and the information handling system container of FIG. 3.

Referring now to FIG. 9, in an embodiment, an information handling system 800, which may have a smaller form factor than the information handling system 500 described above with reference to FIG. 6, is provided and positioned in a protective case 802 which includes a front surface 802*a*, a rear surface 802*b* located opposite the front surface 802*a*, and a plurality of side surfaces 802*c* and 802*d* extending between front surface 802*a* and the rear surface 802*b*. In an embodiment, the protective case 802 may be fabricated from a variety of materials known in the art such as, for example, foam.

Figure 10A:
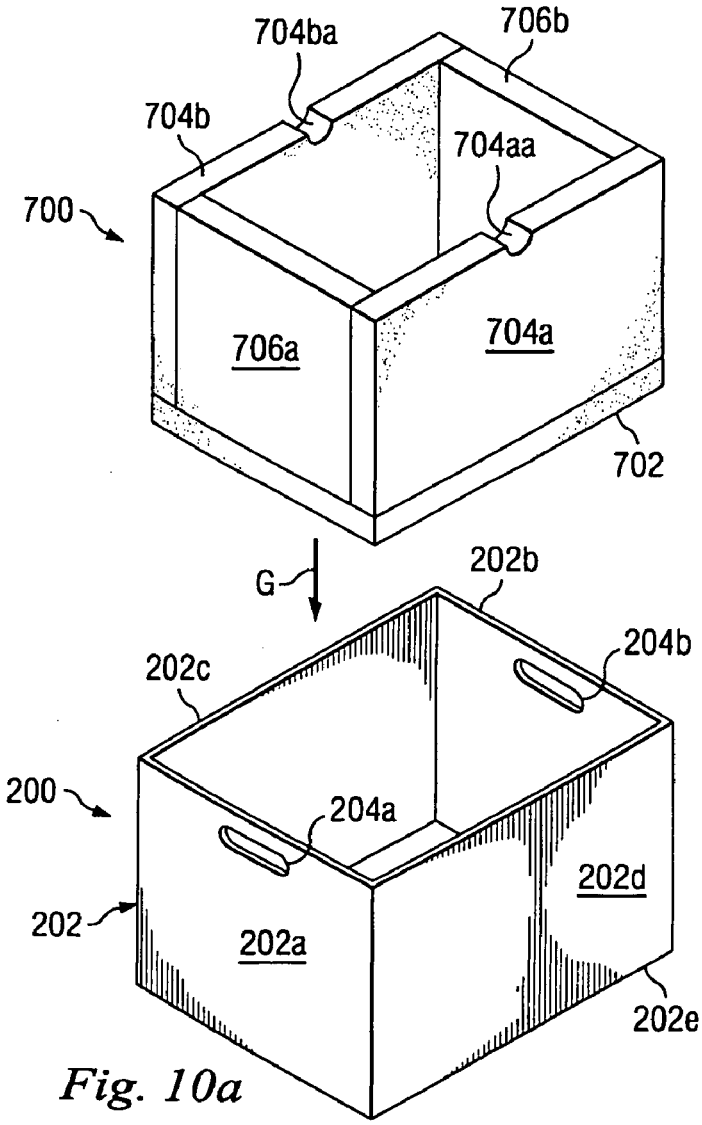
FIG. 10*a* is a perspective view illustrating an embodiment of the padding member of FIG. 8 being positioned in the information handling system container of FIG. 3.
Figure 10B:
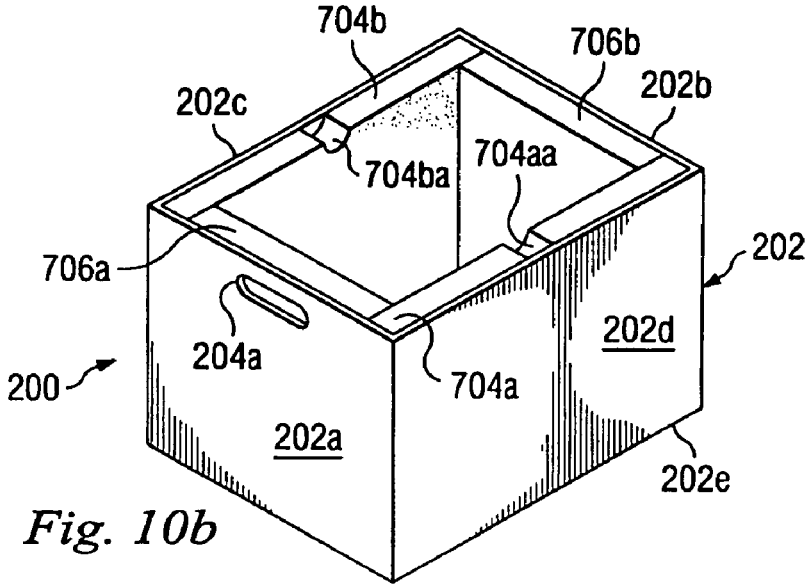
FIG. 10*b* is a perspective view illustrating an embodiment of the padding member of FIG. 8 positioned in the information handling system container of FIG. 3.

Referring now to FIGS. 7, 10*a*, 10*b*, 10*c*, 10*d*, and 10*e*, the padding member 700 and the information handling system 800, described above with reference to FIGS. 8 and 9, may substitute in the method 600 for the padding member 300 and information handling system 500, described above with reference to FIGS. 4 and 6. At step 604, the padding member 700 is positioned in the information handling system container 200. The padding member 700 is positioned adjacent the information handling system container 200 such that the base member 702 is immediately adjacent the information handling system container 100 and with side wall 704*a* on padding member 700 lining up with side wall 202*d* on information handling system container 200 and side wall 704*b* on padding member 700 lining up with side wall 202*c* on information handling system container 200, as illustrated in FIG. 10*a*. The padding member 700 is then moved in a direction G such that it enters the information handling system container 200 and side wall 704*a* on padding member 700 engages side wall 202*d* on information handling system container 200 and side wall 704*b* on padding member 700 engages with side wall 202*c* on information handling system container 200, as illustrated in FIG. 10*b*.

Figure 10C:
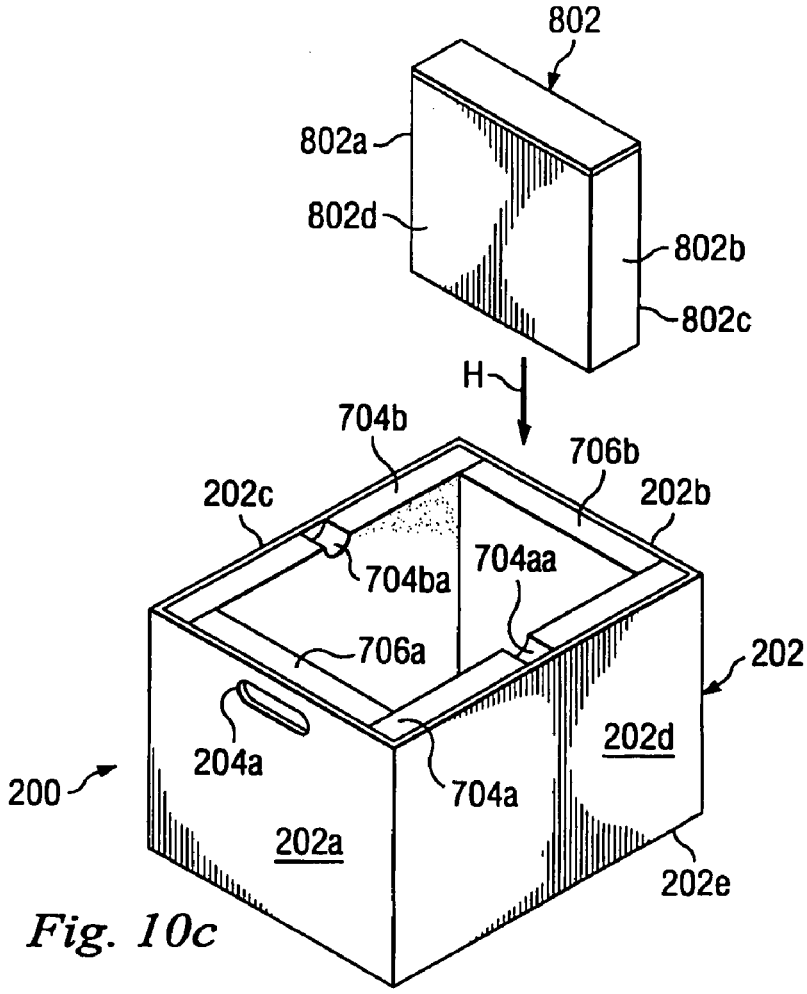
FIG. 10*c* is a perspective view illustrating an embodiment of the information handling system of FIG. 9 being positioned in the information handling system container and the padding member of FIG. 10*b*.
Figure 10D:
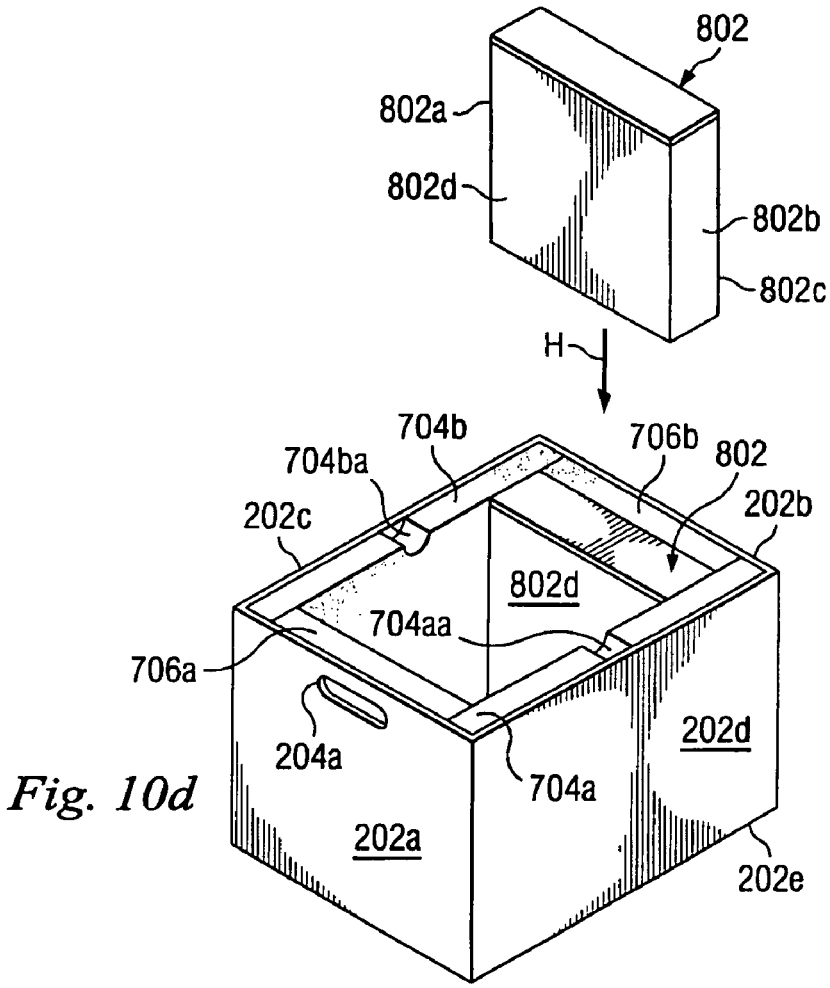
FIG. 10*d* is a perspective view illustrating an embodiment of the information handling system of FIG. 9 positioned in the information handling system container and the padding member of FIG. 10*b*.
Figure 10E:
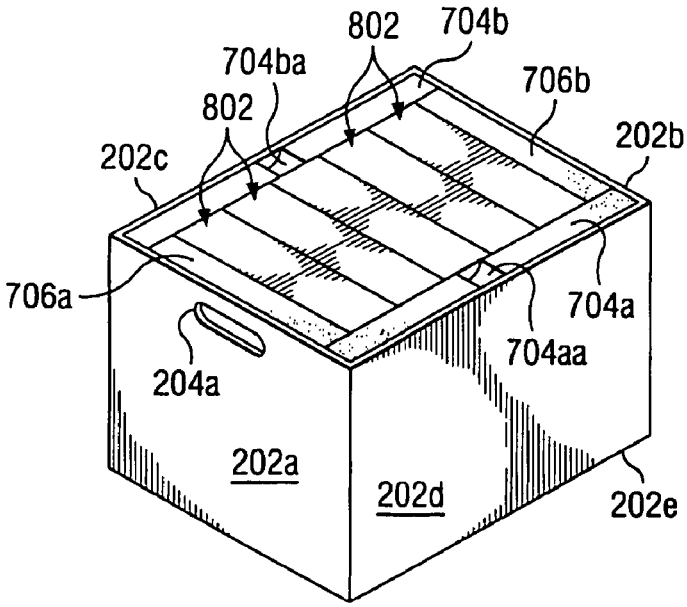
FIG. 10*e* is a perspective view illustrating an embodiment of a plurality of the information handling systems of FIG. 9 positioned in the information handling system container and the padding member of FIG. 10*b*.

The method 600 proceeds to step 606 where a plurality of the information handling systems 800 are positioning in the information handling system container 200. An information handling system 800 in its protective casing 802 is positioned adjacent the information handling system container 200 and padding member 700 such that the side surface 802*d* on protective casing 802 lines up with the side wall 706*b* on padding member 700, as illustrated in FIG. 10*c*. The information handling systems 800 in protective casing 802 is then moved in a direction H such that it enters the information handling system container 200 and the side surface 802*d* on protective casing 802 engages the side wall 706*b* on padding member 700, as illustrated in FIG. 10*d*. A plurality of the information handling systems 800 in protective casings 802 may be positioned in the information handling system container 200 in the same manner as described above, illustrated in FIG. 10*e*. During the positioning of the information handling systems 800 in the information handling system container 200, the access channels 704*aa* and 704*ba* on the padding member 700 assist in the positioning and removal of the information handling systems 800 by providing access to the front surface 802*a* and the rear surface 802*b* of the protective casing 802. The method 600 then proceeds through the remaining steps as previously described. In an embodiment, the padding member 700 may define a plurality of slots, similar to the padding member 300 described above with reference to FIG. 4, for receiving a plurality of the information handling systems 800. In an embodiment, a variety different configurations of padding members may be used in order to transport a variety of different sized information handling systems. In addition, the size and dimensions of the information handling system containers 200 and the system component container 400 may vary in size and dimensions depending on the size and dimensions of the information handling systems to be transported.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An information handling system transporting apparatus comprising:

a housing container;

a plurality of information handling system containers which are positionable in the housing container, each information handling system container including a padding member for receiving a plurality of information handling systems;

a loading door in a surface of the housing container and movable between an open position and a closed position; and a lid attached to the housing container and movable between an open position and a closed position, the lid including a lid securing extended portion operable to cover the loading door when the lid is in the closed position.

2. The apparatus of claim 1 wherein the housing container is fabricated from a corregate material.

3. The apparatus of claim 1 wherein the housing container defines a plurality of lifting channels.

4. The apparatus of claim 1 wherein the plurality of information handling system containers are fabricated from a corregate material.

5. The apparatus of claim 1 wherein the padding members are fabricated from a foam material.

6. The apparatus of claim 1 further comprising:

a system component container which is positionable in the housing container.

7. The apparatus of claim 6 wherein the plurality of information handling system containers are positionable in the housing container adjacent to each other and the system component container is positionable in the housing container above the information handling system containers.

8. An information handling system transporting apparatus comprising:

a housing container fabricated from a corrugate material;

a plurality of information handling system containers fabricated from a corrugate material and positioned in the housing container, each information handling system container including a padding member for housing a plurality of information handling systems;

a loading door in a surface of the housing container and movable between an open position and a closed position; and a lid attached to the housing container and movable between an open position and a closed position, the lid including a lid securing extended portion operable to cover the loading door when the lid is in the closed position.

9. The apparatus of claim 8 wherein the housing container comprises a housing lid.

10. The apparatus of claim 8 wherein the padding members are fabricated from a foam material.

11. The apparatus of claim 8 further comprising:

a plurality of information handling systems positioned in each information handling system container.

12. The apparatus of claim 8 further comprising:

a system component container positioned in the housing container.

13. The apparatus of claim 12 wherein the plurality of information handling system containers are positioned in the housing container adjacent to each other and the system component container is positioned in the housing container above the information handling system containers.

14. The apparatus of claim 12 further comprising:

a plurality of information handling systems positioned in each information handling system container; and a plurality of system components positioned in the system component container.

15. A method for transporting a plurality of information handling system components comprising:

providing a housing container;

providing a plurality of information handling system containers;

positioning a plurality of information handling systems in each information handling system container;

securing the information handling systems in the housing container;

providing a loading door in a surface of the housing container and movable between an open position and a closed position; and providing a lid attached to the housing container and movable between an open position and a closed position, the lid including a lid securing extended flap operable to cover the loading door when the lid is in the closed position.

16. The method of claim 15 further comprising:

providing a system component container;

positioning the system component container in the housing container; and positioning a plurality of system components in the system component container.

17. An information handling system transporting apparatus comprising:

a plurality of padding members, each padding member containing a plurality of information handling systems;

a housing container;

a plurality of information handling system containers in the housing container, each information handling system container including at least one of the padding members;

a loading door in a surface of the housing container and movable between an open position and a closed position;

a lid attached to the housing container and movable between an open position and a closed position, the lid including a lid securing extended portion operable to cover the loading door when the lid is in the closed position; and a system component container in the housing container, operable to contain components, the system component container being positioned in the housing container on the information handling system containers adjacent the lid and the loading door.

* * * * *